US005396735A

United States Patent [19]

Dietrich

[11] Patent Number: 5,396,735

[45] Date of Patent: Mar. 14, 1995

[54] APPARATUS FOR ATTACHMENT OF SEALS TO GARAGE DOORS

[75] Inventor: Darrell R. Dietrich, Topeka, Kans.

[73] Assignee: The Garage Door Group, Inc., Lawrence, Kans.

[21] Appl. No.: 103,430

[22] Filed: Aug. 6, 1993

[51] Int. Cl.[6] ..... E06B 7/16

[52] U.S. Cl. ..... 49/499.1; 49/493.1; 403/282

[58] Field of Search ..... 49/499.1, 493.1, 492.1, 49/489.1, 475.1; 403/282, 279, 274, 284

[56] References Cited

U.S. PATENT DOCUMENTS

| | | | |
|---|---|---|---|
| 808,316 | 12/1905 | Taylor | 49/493.1 |
| 2,070,725 | 2/1937 | Gail | 49/499.1 X |
| 2,686,943 | 8/1954 | Kunkel | 49/499.1 X |
| 2,934,802 | 5/1960 | Shekter | 49/499.1 X |
| 3,411,246 | 11/1968 | Miller | 49/493.1 |
| 4,691,478 | 9/1987 | Lorg | 49/499.1 |
| 4,771,505 | 9/1988 | Dilich | 49/499.1 X |

*Primary Examiner*—Jerry Redman

*Attorney, Agent, or Firm*—Hovey, Williams, Timmons & Collins

[57] ABSTRACT

A garage door bottom seal assembly includes a garage door bottom panel presenting a pair of elongated, laterally spaced apart bottom wall sections, and an elongated intermediate wall section extending between the bottom wall sections and presenting a recess extending along the length of the bottom panel. An elongated seal support presents an upstanding connector element extending along the length thereof and is located within the recess. The intermediate wall section is formed to interfit with the connector element at locations along the length of the intermediate wall section for securing the seal support to the bottom panel. An elongated, resilient seal is operatively coupled with the seal support. Preferably, the seal and seal support present an astragal seal which can be affixed to the normal groove structure of a conventional tongue and groove garage door panel. The assembly is constructed by positioning the support on the panel and deforming the intermediate wall section to interfit with the connector element at locations along the length of the intermediate wall section, in order to secure the seal support to the bottom panel.

9 Claims, 5 Drawing Sheets

50
48
52
10
26
28
54
36
58
46
30
56

APPARATUS FOR ATTACHMENT OF SEALS TO GARAGE DOORS

BACKGROUND OF THE INVENTION

1. Field of the Invention

The present invention relates generally to garage doors and, more particularly to a bottom seal assembly for use along the bottom edge of a garage door, and a method of constructing such assemblies.

2. Description of the Prior Art

Presently, garage doors are conventionally formed of a plurality of interconnected, elongated steel panels arranged with tongue and groove structure for interfitting of the panels with one another and thereby permitting the door to be retracted along a curved track positioned within the garage.

The lower edge of the bottom panel of a conventional garage door typically is provided with a U-shaped resilient seal that is attached to the door by an elongated support on which the seal is retained; this is often referred to in the art as an astragal seal. This support is secured to the bottom panel of the door by a plurality of metal screws or the like spaced along the length of the support.

Numerous problems arise from this known construction. For example, because the metal screws used in the assembly extend upward through a lower intermediate wall section of the door, they are exposed and present a risk of injury to persons gripping the bottom of the door during opening and closing. These metal screws can also present a problem of electrolysis corrosion owing to the fact that the screws are formed of a dissimilar metal as compared with the aluminum extrusion of the astragal seal. In addition, screw-type fasteners are labor intensive and destroy the integrity of prepainted steel door panels, exposing the panel material to oxidation and producing loose shavings.

OBJECTS AND SUMMARY OF THE INVENTION

It is an object of the present invention to provide a garage door having an astragal bottom seal assembly of simplified construction, which is easy to assemble while being of high quality and free of protruding screws or the like which might cause injury.

In accordance with these and other objects evident from the following description of a preferred embodiment, the invention relates to a garage door bottom seal assembly comprising a garage door bottom panel presenting a pair of elongated, laterally spaced apart bottom wall sections, and an elongated intermediate wall section extending between and interconnecting said bottom wall sections. The intermediate wall section presents a recess extending along the length of the bottom panel. In practice, the normal groove construction provided as a part of a tongue and groove garage door panel can be used without significant modification to provide the desired bottom panel and recess construction. An elongated seal support is also provided which presents an upstanding connector element extending along the length thereof and located within this recess. The intermediate wall section is formed to interfit with the connector element at certain locations along the length of the intermediate wall section for securing the seal support to the bottom panel. An elongated, resilient seal is operatively coupled with the seal support, with the resilient seal and its connection structure presenting an astragal seal.

By this construction, numerous advantages are achieved. For example, by providing a bottom panel with an intermediate wall having a recess extending along the length of the panel, and a seal support having a connector element extending into the recess, the support may be fastened to the panel simply by deforming the intermediate wall section to interfit with the connector element.

According to another aspect of the present invention, a method of fabricating the garage door bottom seal assembly includes, among other steps, the step of positioning the connector element of the support within the recess of the bottom panel, and deforming the panel at certain locations in order to secure the seal support to the bottom panel. Thus, construction of the seal assembly is simplified by obviating the need for screw-type fasteners, and it is possible to complete the assembly while preserving the prepainted finish of the panels so as to reduce the opportunity for oxidation.

BRIEF DESCRIPTION OF THE DRAWINGS

A preferred embodiment of the present invention is described in detail with reference to the attached drawing figures, wherein.

DETAILED DESCRIPTION OF THE PREFERRED EMBODIMENTS

Figure 2:
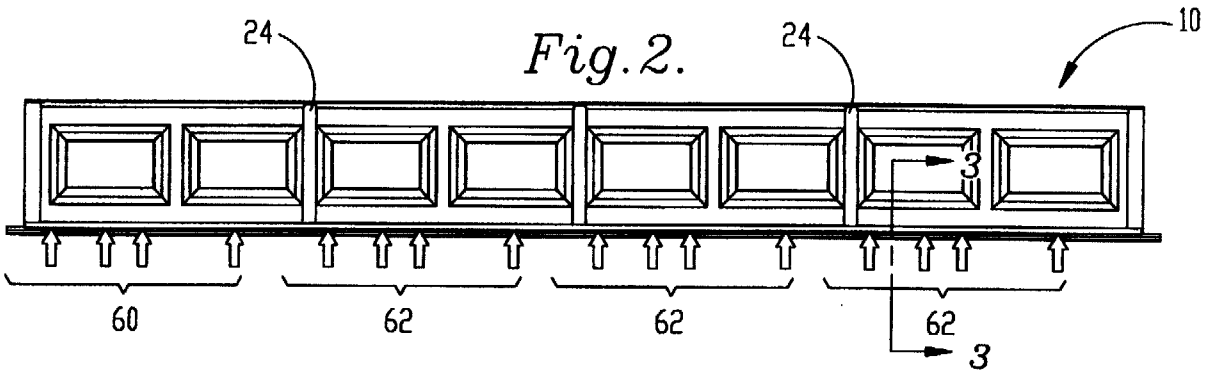
FIG. 2 is a front elevational view of the bottom panel of a garage door, illustrating a bottom seal assembly constructed in accordance with the preferred embodiment.
Figure 1:
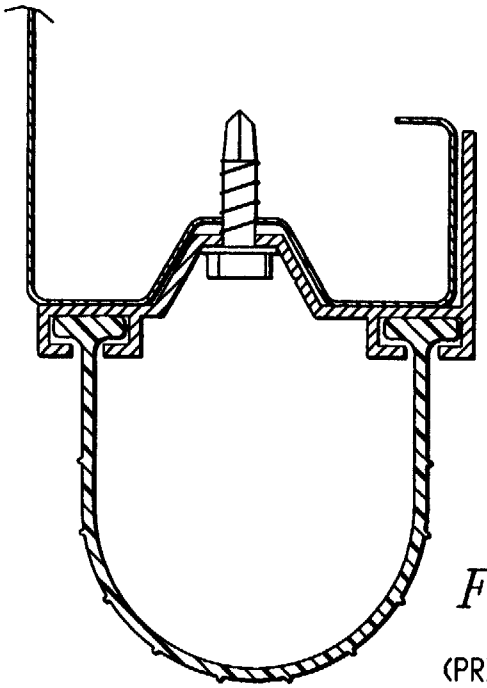
Fig. 1. (PRIOR ART)
FIG. 1 is a sectional view of a conventional garage door bottom seal assembly, illustrating the manner in which the seal,assembly is assembled on a garage door.

A garage door bottom seal assembly constructed in accordance with the present invention is illustrated in FIG. 2, as mounted on the bottom panel of a garage door. Preferably, the bottom panel 10 is formed of steel or other conventional material capable of being cold-worked, and is prepainted to provide protection against oxidation.

Figure 3:
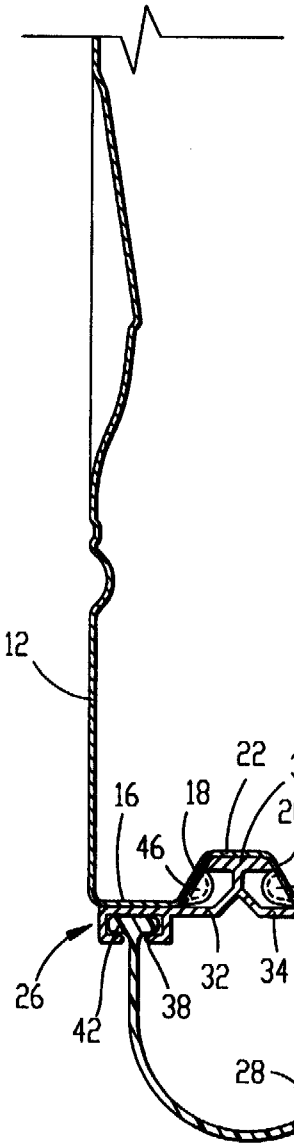
FIG. 3 is a sectional view of the assembly, taken along line 3—3 of FIG. 2.

The garage door bottom panel is shown in FIG. 3, and presents a pair of elongated, laterally spaced vertical bottom wall sections 12, 14, and an elongated, horizontal, intermediate wall section 16 extending between and interconnecting the bottom wall sections. The intermediate wall section 16 presents a recess extending along the length of the bottom panel, the recess being defined by a pair of downwardly and outwardly diverging sidewall segments 18, 20 and an uppermost segment 22 extending between the sidewall segments. Thus, the recess takes the form of a trough-like channel having a trapezoidal cross-sectional shape. Those skilled in the art will understand that the bottom panel depicted in FIG. 3 is simply the normal groove structure provided in conventional tongue and groove door panels, with the exception of the crimping later to be described.

A plurality of laterally spaced reinforcing stiles 24 are provided on the panel 10, as shown in FIG. 2, and add rigidity to the construction. These stiles preferably are comprised of individual columns extending between the upper and lower edges of the panel and received between the front and rear upstanding sections 12, 14 of the bottom panel.

As illustrated in FIG. 3, the bottom seal assembly includes an elongated seal support 26 and a U-shaped resilient seal 28 which cooperatively present an astragal seal. The seal support includes an upstanding T-shaped connector element 30 and a pair of laterally extending wall portions 32, 34 which extend laterally from the connector element. The wall portions 32, 34 are adapted to engage the intermediate wall section 16 of the bottom panel when the seal assembly is properly positioned relative to the door.

An upstanding rear portion 36 of the support extends upward from the rear wall portion 34 and is adapted to engage the upstanding sidewall segment 14 to assist in positioning the seal support relative to the panel. The T-shaped connector element 30 has an uppermost laterally extending web adapted to engage the uppermost segment of the recess when the support is assembled on the panel. Cavities are defined between the web and each of the wall portions 32, 34 of the support.

The wall portions 32, 34 include elongated channels 38, 40 which open up to a side of the support opposite the connector element 30. The resilient seal 28, which is preferably formed of a relatively soft, pliable rubber or other material, is of generally uniform thickness, including a bead 42 running along the length of the seal adjacent each lateral edge thereof. Each bead 42 is sized for receipt within one of the channels 38, 40 so that the seal may be folded into the U-shaped configuration shown in FIG. 3, and the beads pushed into and through the channels. In this manner, the resilient seal is retained on the support in such a way as to present a cushion and seal along the bottom edge of the garage door so that when the door is closed small gaps between the door and floor are closed.

The support 26 is secured to the bottom panel 10 by a plurality of inward extending deformations 46 each defining a crimp joint. These deformations are formed in the sidewall segments 18, 20 of the intermediate wall section in a manner described more fully below. The deformations 46 protrude into the cavities between the web of the connector element 30 and the wall portions 32, 34 by a distance sufficient to prevent removal of the connector element from the recess. In addition, the deformations also engage the web and press it against the uppermost segment so that the support is prevented from being shifted relative to the panel and is positively locked in place.

By constructing the seal assembly in this manner, numerous advantages are achieved. For example, by securing the support to the bottom panel by means of a connector element held in place by the crimp joint deformations formed in the recess walls, the interconnection between the bottom panel and seal support is free of threaded fasteners. Thus, when prepainted steel is used to form the panel, the seal assembly may be attached to the bottom panel without requiring penetration of the painted surface of the panel material.

Figures 4, 5:
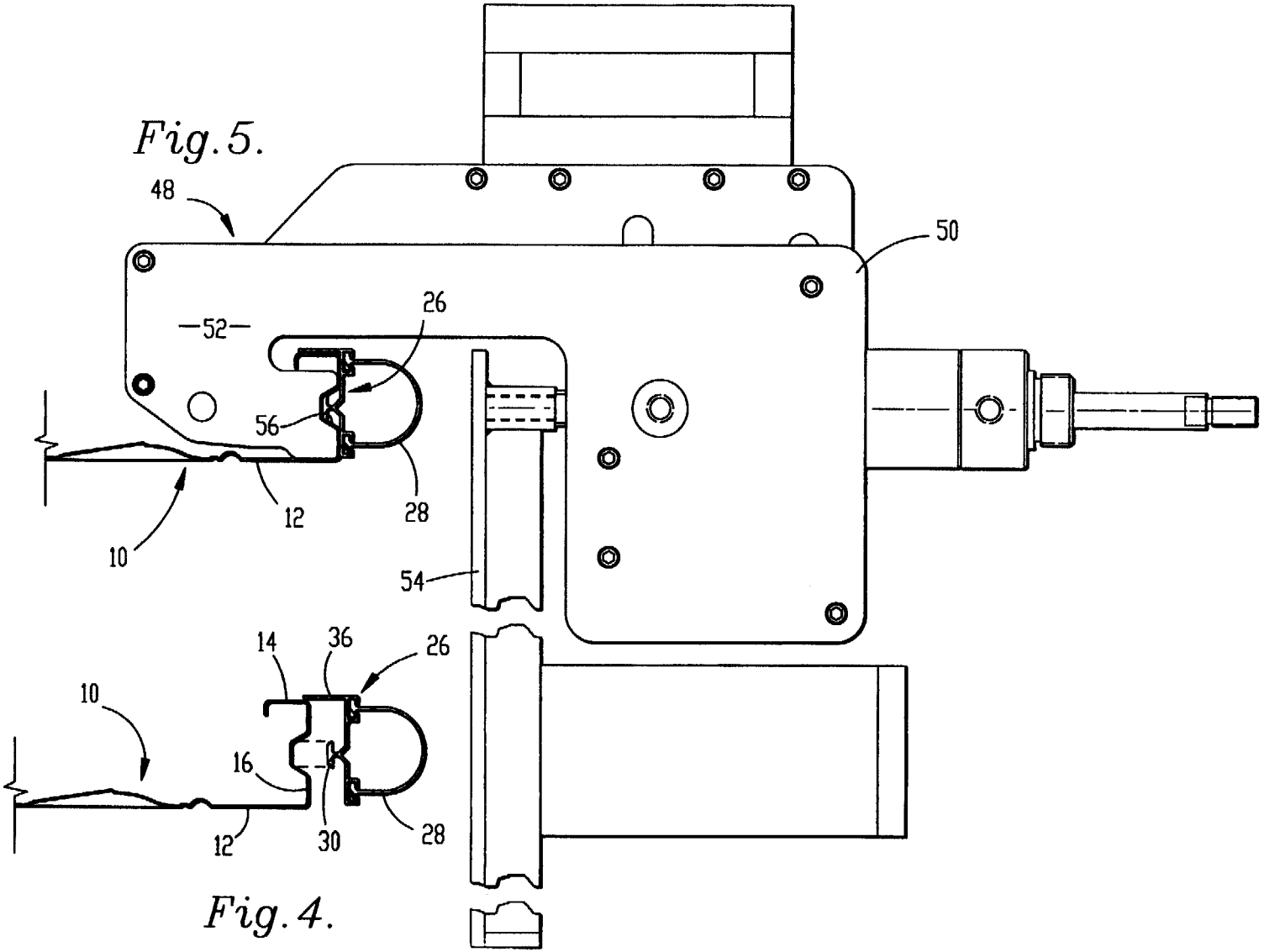
FIG. 4 is a side sectional view of the assembly, illustrating the initial steps of construction.
FIG. 5 is a side sectional view of the assembly as it is supported on a crimping device, illustrating the crimping device and the manner in which the assembly is supported prior to a crimping operation.

A crimping device 48 for forming the deformations in the recess walls of the bottom panel is shown in FIG. 5, and broadly includes a stationary frame 50, an anvil 52 on which the bottom panel is positioned prior to carrying out a crimping operation, and a platen 54.

Figure 6:
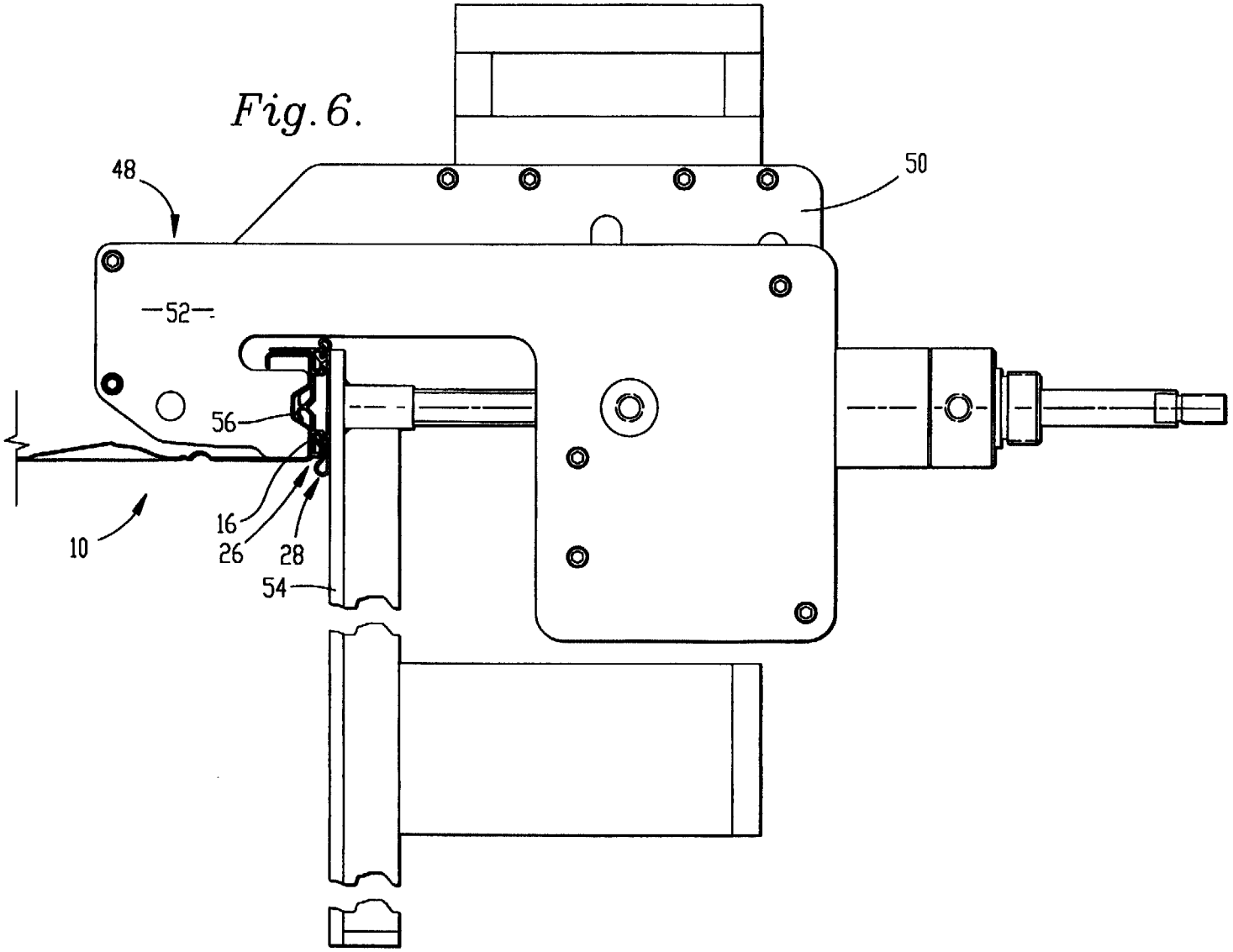
FIG. 6 is a side sectional view similar to FIG. 5, illustrating an initial step of operation of the crimping device.
Figures 7, 7A:
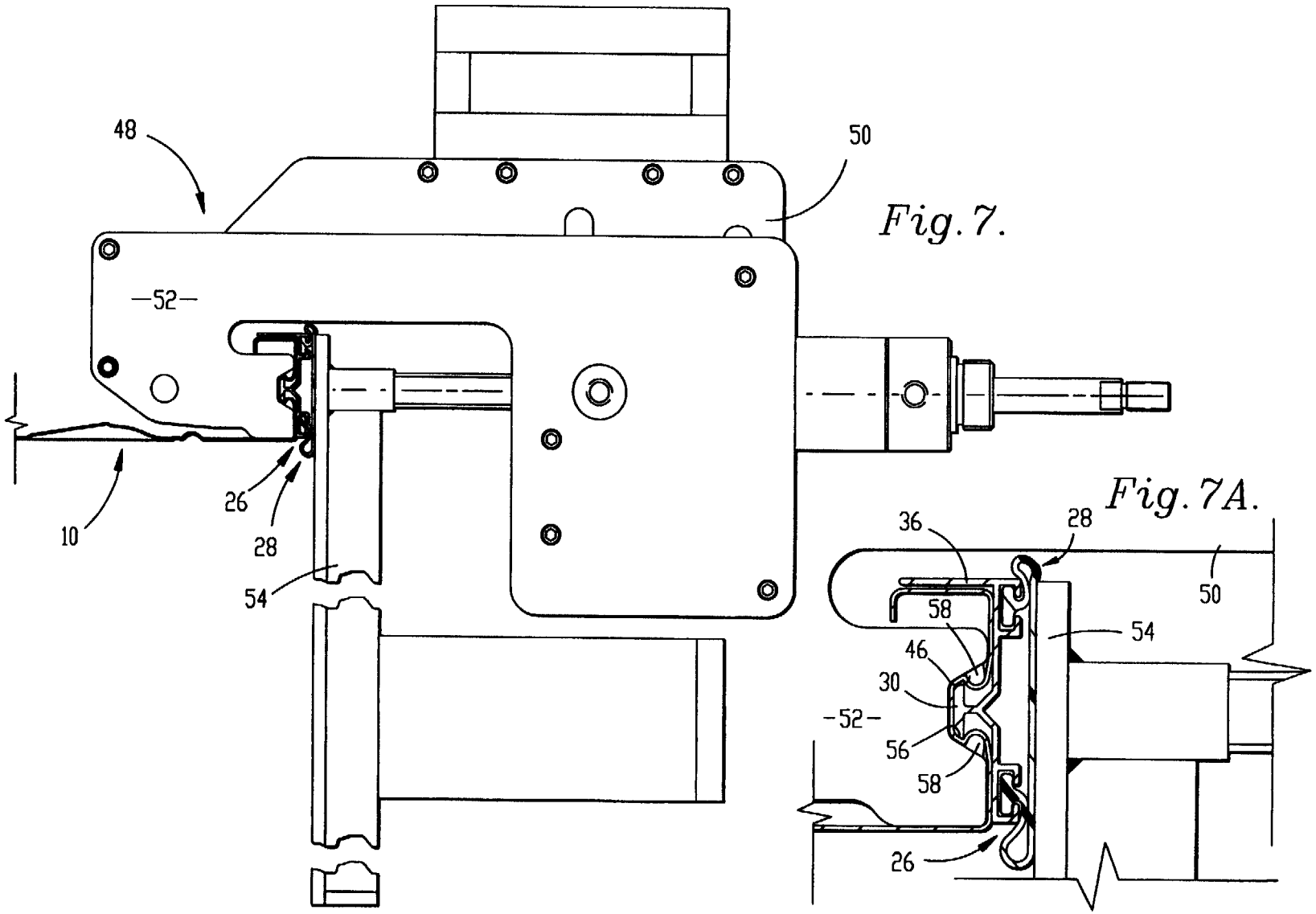
FIG. 7 is a side sectional view similar to FIG. 5, illustrating a subsequent step of operation of the crimping device.
FIG. 7A is a fragmentary, sectional exploded view of the assembly during the subsequent step of operation of the crimping device shown in FIG. 7.

The frame 50 is supported on the ground and includes conventional means for driving the platen between a retracted position, as shown in FIG. 5, and an extended position as shown in FIG. 6. The anvil 52 is supported on the frame and includes a channel-shaped recess 56 adapted to be aligned with the intermediate wall section of the assembly when the bottom panel and seal support are positioned on the device. As shown in FIG. 7A, a pair of jaws 58 are provided on the anvil which are movable between a retracted position removed from the recess 56 and an extended position protruding inward into the recess.

During construction of the assembly, as shown in FIG. 4, after the bottom panel has been formed and the seal has been fitted on the support, the support is placed in contact with the bottom panel such that the T-shaped connector element 30 extends into the recess and the upstanding rear portion 36 of the support is resting on the upstanding rear wall section 14. The support is retained in this position naturally when the panel is oriented in a horizontal plane with the rear side of the panel facing upward.

In this horizontal orientation, the panel and support are together positioned on the anvil 52 of the crimping device, as shown in FIG. 5, with the recess and T-shaped connector element 30 received within the recess 56 of the anvil. Thereafter, as shown in FIG. 6, the platen 54 is moved to the extended position, pressing the support 26 against the intermediate wall section 16 of the panel, and forcing both toward the anvil 52.

Once the assembly components are pressed firmly against the anvil (see FIG. 7A), the jaws 58 are actuated and move from the retracted to the extended position. The force urging the jaws into the recess 56 is sufficient to deform the sidewall segments of the intermediate wall section so that the crimp joint deformations are permanently formed. As shown in FIG. 2, the crimping device preferably includes four spaced pairs of these crimping jaws, as indicated by the four arrows grouped together by the bracket 60, so that deformations may simultaneously be formed at a plurality of locations along the length of the seal assembly.

Figure 8:
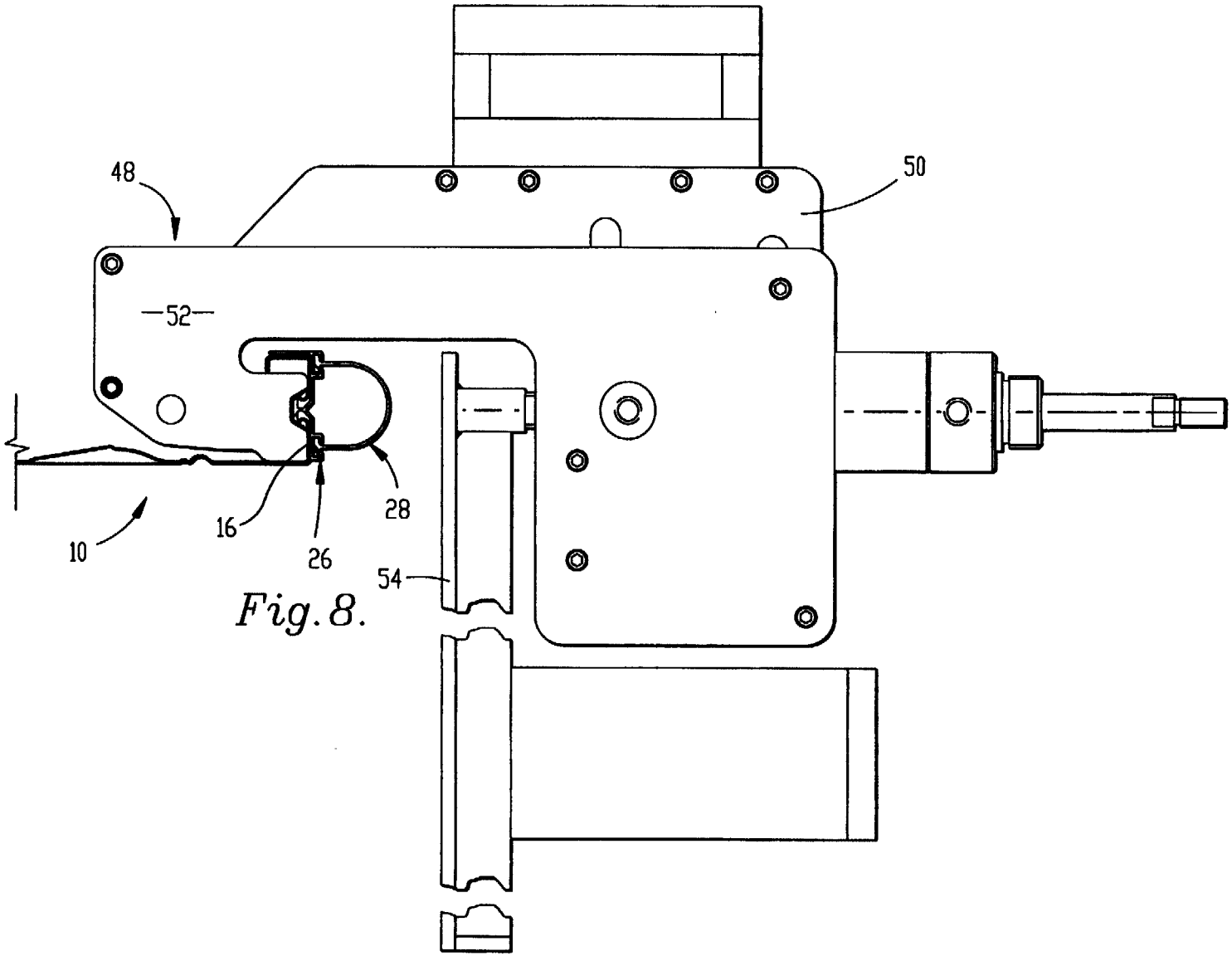
FIG. 8 is a side sectional view similar to FIG. 5, illustrating a final step of operation of the crimping device prior to completion of the assembly.

If necessary, once a first plurality of deformations are formed, as indicated by the bracket 60, the assembly may be moved longitudinally relative to the crimping device to position an adjacent portion of the assembly in alignment with the jaw pairs, as depicted by the remaining brackets 62. In this manner, deformations are formed along the entire length of the bottom panel. In between crimping operations, the jaws 58 and the platen 54 are retracted, as shown in FIG. 8, to enable the assembly and panel to be removed from the anvil and repositioned, if necessary, for a subsequent crimping operation.

Although the invention has been described with reference to the preferred embodiment illustrated in the attached drawing figures, it is noted that substitutions may be made and equivalents employed herein without departing from the scope of the invention as recited in the claims.

I claim:

1. A garage door bottom seal assembly comprising:

a garage door bottom panel presenting a pair of elongated, laterally spaced apart bottom wall sections, and an elongated intermediate wall section extending between and interconnecting said bottom wall sections, said intermediate wall section presenting a recess extending along the length of the bottom panel;

an elongated seal support presenting an upstanding connector element extending into said recess, said intermediate wall section being crimped at spaced locations along the length thereof to present inwardly extending deformations that engage the upstanding connector element for securing said seal support to said bottom panel; and an elongated, resilient seal operatively coupled with said seal support.

2. The assembly of claim 1, said seal support including a pair of laterally extending wall portions respectively underlying said bottom wall sections and on opposite sides of said connector element.

3. The assembly of claim 1, said connector element having a pair of laterally spaced apart channels, said seal being generally U-shaped in cross-section with uppermost, elongated beads, each of said beads being received within a corresponding channel.

4. The assembly of claim 1, the interconnection between said bottom panel and seal support being free of threaded fasteners.

5. A garage door bottom seal assembly comprising:

a garage door bottom panel presenting a pair of elongated, laterally spaced apart bottom wall sections, and an elongated intermediate wall section extending between and interconnecting said bottom wall sections, said intermediate wall section presenting a recess extending along the length of the bottom panel;

an elongated seal support presenting an upstanding connector element extending along the length thereof and located within said recess, said upstanding connector element being generally T-shaped in cross-section and presenting an uppermost, laterally extending web, said intermediate wall section being formed to interfit with said connector element at certain locations along the length of the intermediate wall section for securing said seal support to said bottom panel, said intermediate wall section being crimped at spaced locations along the length thereof to present inwardly extending deformations extending beneath said uppermost web; and an elongated, resilient seal operatively coupled with said seal support.

6. The assembly of claim 5, said intermediate wall section including an uppermost segment in contact with the web, and a pair of down-wardly and outwardly diverging sidewall segments, said sidewall segments being crimped to present said deformations.

7. A garage door bottom seal assembly comprising:

a garage door bottom panel presenting a pair of elongated, laterally spaced apart bottom wall section, an elongated intermediate wall section extending between and interconnecting said bottom wall sections, and a plurality of spaced apart, laterally extending, reinforcing stiles extending upwardly from said intermediate wall section, said intermediate wall section presenting a recess extending along the length of the bottom panel;

an elongated seal support presenting an upstanding connector element extending along the length thereof and located within said recess, said intermediate wall section being formed to interfit with said connector element at certain locations along the length of the intermediate wall section for securing said seal support to said bottom panel, said intermediate wall section being crimped to present deformations adjacent to and on opposite sides of each of said stiles; and an elongated, resilient seal operatively coupled with said seal support.

8. A garage door bottom seal assembly comprising:

a garage door bottom panel presenting a pair of elongated, laterally spaced apart bottom wall sections, and an elongated intermediate wall section extending between and interconnecting said bottom wall section;

an elongated seal support adjacent said bottom panel, one of said intermediate wall section and said seal support presenting elongated recess-defining walls extending along the length thereof, the other of said intermediate wall section and said seal support presenting an elongated connector element extending along the length thereof and located within the recess defined by said walls, said recess-defining walls being crimped at spaced locations along the length thereof to present inwardly extending deformations that engage the connector element for securing said seal support to said bottom panel; and an elongated, resilient seal operatively coupled with said seal support.

9. The assembly of claim 8, said intermediate wall section including said recess-defining walls, said seal support including said connector element.

* * * * *